US007473094B2

(12) United States Patent
Movassaghi

(10) Patent No.: US 7,473,094 B2
(45) Date of Patent: Jan. 6, 2009

(54) MULTIPLE PLATE COMBUSTOR

(75) Inventor: Mehrzad Movassaghi, Vancouver (CA)

(73) Assignee: Fama Holdings Ltd. (CA)

( * ) Notice: Subject to any disclaimer, the term of this patent is extended or adjusted under 35 U.S.C. 154(b) by 157 days.

(21) Appl. No.: 10/530,014

(22) PCT Filed: Oct. 1, 2003

(86) PCT No.: PCT/CA03/01514

§ 371 (c)(1),
(2), (4) Date: Sep. 6, 2006

(87) PCT Pub. No.: WO2004/031651

PCT Pub. Date: Apr. 15, 2004

(65) Prior Publication Data

US 2007/0042300 A1 Feb. 22, 2007

(30) Foreign Application Priority Data

Oct. 1, 2002 (IT) ..... TO2002A0850

(51) Int. Cl.
*F23C 15/00* (2006.01)
*F02B 45/06* (2006.01)
*F22B 31/00* (2006.01)

(52) U.S. Cl. ..... 431/1; 431/160; 122/24

(58) Field of Classification Search ..... 122/24, 122/17; 431/1, 12, 160
See application file for complete search history.

(56) References Cited

U.S. PATENT DOCUMENTS 6,035,810 A * 3/2000 Movassaghi ..... 122/24
6,464,490 B1 10/2002 Chato

FOREIGN PATENT DOCUMENTS

| | | |
|---|---|---|
| EP | 0950853 | 10/1999 |
| WO | WO 97/20171 | 6/1997 |
| WO | WO 00/12934 | 3/2000 |
| WO | WO 01/53750 | 7/2001 |

* cited by examiner

*Primary Examiner*—Alfred Basichas
(74) *Attorney, Agent, or Firm*—Vermette & Co.; Clifford W. Vermette; Denis R. O'Brien

(57) ABSTRACT

The invention consists of a pulse combustor, comprising two spaced apart outer plates, the outer plates having flat outer regions, conical regions inside of the flat regions and central hubs, where the volume between conical regions of the plates defines a combustion chamber. The pulse combustor further comprises a plurality of intermediate plates located between the outer plates, the plurality of intermediate plates being spaced apart to form tailpipe regions therebetween and between the outer plates and adjacent ones of the intermediate plates and a burner coupled to one of the hubs, the burner operative to ignite a fuel/air mixture in the combustion chamber. The outer and intermediate plates have spiral coolant passageways therein for conducting cooling fluid to cool expanding gases traveling between the plates through the tailpipe regions. The invention further consists of a burner assembly for use in a combustion chamber.

11 Claims, 10 Drawing Sheets

MULTIPLE PLATE COMBUSTOR

This application claims the filing date benefit of PCT Application No. CA2003/001514 filed Oct. 1, 2003, which in turn claims priority to Italian Patent Application No. 2002A00850 filed Oct. 1, 2002.

FIELD

The invention relates to a pulse combustor using multiple plates for increased power output.

BACKGROUND

A pulse combustor is a device in which a mixture of air and fuel is initially ignited by, for example, an ignition rod. The ignited gases expand rapidly with an associated rapid increase in pressure and temperature. A resultant pressure wave travels down the device expelling the burnt gases out of an exhaust region. Heat exchange occurs at the walls of the device cooling the gases and enhancing the pressure drop occurring after passage of the pressure wave. This pressure drop due to expansion of the gases combined with the cooling caused by heat exchange at the walls causes the pressure inside the combustion chamber to drop below the ambient pressure (i.e. negative pressure) allowing new gases to be drawn into the combustion chamber. The exhaust flow comes to a rest, with some gases exiting the plates and some returning into the combustion chamber. The flow in the exhaust region reverses and compresses the new air and gas mixture and with the temperature in the combustion chamber still being high, ignition occurs once again. The pulse combustor is used primarily as a hot water boiler, water heater, or low and high pressure steam boiler.

U.S. Pat. No. 4,968,244 describes a pulse combustor with a radial exhaust chamber and a carburetor coupled to the combustion chamber for injecting a pre-determined distribution of fuel mixture into the combustion chamber. The design of the casing of the exhaust chamber comprises an inside plate and outside plate located on each side of the combustion chamber. The exhaust chamber has spiral coolant grooves machined onto in the inside plate which are covered by the outside plate to form a coolant passageway. The usage of two plates bonded together and machining a spiral groove in the plate makes construction difficult and expensive. Moreover, the rapid heating and cooling stresses the bonding between the disc and plate making the device susceptible to coolant leaks. Finally, the somewhat complex design of the carburetor adds to the expense of the device. Also, operation of this design is limited to a high gas pressure which can be above regulated levels, making it unusable for certain areas, such as residential.

PCT Application No. WO97/20171 describes a pulse combustor having a central combustion chamber surrounded by an exhaust chamber, wherein a portion of the combustion and exhaust chambers are formed between two spaced apart walls of spiral wound coolant tubing. The coolant tubing, which forms the walls, provides much greater heat transfer area while at the same time considerably simplifying the construction of the combustor. A fuel nozzle is located at an inlet to the combustion chamber and a spark generator is provided in the combustion chamber and proximate the nozzle in order to ignite the fuel entering the pulse combustor upon startup.

The limitations on the radius of the combustion chamber and the radius of the tail pipe result in a limit to the total amount of power (BTU's of heat generation) achieved by the pulse combustor. Therefore, a combustor is needed that is scaleable to achieve an increased power output.

It is an object of this invention to provide a pulse combustor that has a scaleable power output.

It is a further object of this invention to provide a modified burner for a pulse combustor that provides for a scaleable power output.

SUMMARY

The invention consists of a pulse combustor, comprising two spaced apart outer plates, the outer plates having flat outer regions, conical regions inside of the flat regions and central hubs, where the volume between conical regions of the plates defines a combustion chamber. The pulse combustor further comprises a plurality of intermediate plates located between the outer plates, the plurality of intermediate plates being spaced apart to form tailpipe regions therebetween and between the outer plates and adjacent ones of the intermediate plates and a burner coupled to one of the hubs, the burner operative to ignite a fuel/air mixture in the combustion chamber. The outer and intermediate plates have spiral coolant passageways therein for conducting cooling fluid to cool expanding gases traveling between the plates through the tailpipe regions.

Preferably, the intermediate plates are spaced to provide variable resistance to create a uniform gas flow between each set of adjacent plates.

Optionally, the pulse combustor may include a burner assembly mounted in the combustion chamber. The burner assembly having a hollow elongated tube with nozzle openings spaced around a cylindrical surface thereof to equalize gas flow into tailpipe regions between adjacent ones of said intermediate and outer plates.

The invention also consists of a burner assembly for use in a combustion chamber, comprising an elongated hollow tube, having a plurality of nozzle openings along its cylindrical surface. One end of the burner is couplable to a burner nozzle such that upon ignition of a fuel mixture in the hollow tube, ignited gas escapes uniformly around and along the hollow tube.

The hollow elongated tube may be cylindrical, with a plurality of radially spaced apart elongated slots extending along a length of its cylindrical surface and including a plurality of elongated nozzle assemblies having nozzle openings spaced along its length. The nozzle assemblies having a plenum accessing the nozzle openings and each nozzle assembly affixed to an outer surface of the cylinder over an associated slot.

BRIEF DESCRIPTION OF THE DRAWINGS

The invention itself both as to organization and method of operation, as well as additional objects and advantages thereof, will become readily apparent from the following detailed description when read in connection with the accompanying drawings:

FIG. 5C is a view taken along the line BB;

DETAILED DESCRIPTION

Figure 1A:
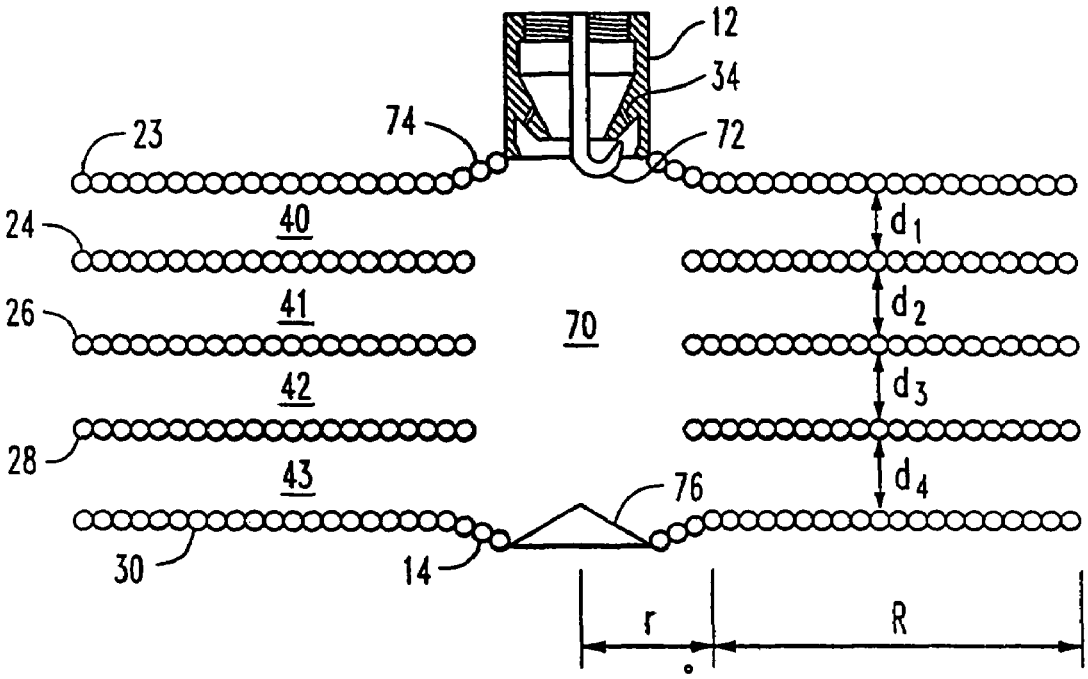
FIG. 1A is a cross-sectional view in elevation of a multiple plate combustor assembly without a burner assembly.

Referring to FIG. 1A the multiple plate pulse combustor assembly has 5 disc-shaped plates or coils 23, 24, 26, 28, and 30, which are held in parallel orientation by a nut and bolt assembly (not shown). A burner nozzle 12 passes into a central opening of the first coil or plate 23. A flame spreader 76 is mounted in the center of the last coil 30. Between sets of adjacent coils (23,24), (24,26), (26,28), (28,30) there are respective tailpipe regions 40, 41, 42, and 43 having respective gaps $d_1$, $d_2$, $d_3$, and $d_4$. Each of the outer coils 23 and 30 has an associated central conical region 74 and 14, respectively.

In operation an air and gas mixture enters the burner 36 and some of the mixture passes through the orifices 34. An ignition rod or spark plug 72 ignites the mixture producing a flame that rapidly spreads towards the flame spreader 76. Combustion takes place inside the combustor chamber 70 in a cyclical fashion. The combustion of the air/gas mixture generates a sudden increase in the pressure of the combustion chamber 70, which, in turn, generates pressure waves. The pressure waves travel radially outwardly and carry the exhaust product through the tailpipe regions 40, 41, 42, and 43 towards the perimeter of the coils 23, 24, 26, 28, and 30. The sudden expansion of the gaseous exhaust products, together with the cooling through heat exchange at the walls of the coils 23, 24, 26, 28, and 30, creates a low pressure inside the combustion chamber 70. The low pressure causes the pressure waves reaching the perimeter of the coils 23, 24, 26, 28, and 30 to come to an instantaneous rest. Some gases are exhausted into the surrounding ambient area around the combustor 10, while some return to the combustion chamber in the form of rarefaction waves. Simultaneously, due to the low pressure in the combustion chamber, a new volume of the air/gas mixture is introduced into the combustion chamber 70. The returning waves pre-compress this new volume of air/gas mixture. As the temperature in the combustion chamber remains elevated, the new air/gas mixture is ignited without the need for a spark and the combustion cycle is repeated.

The heat generation of a two plate combustor is limited to about 600,000 BTUs. One cannot simply scale up the combustor to increase the power generation. By putting one or more plates between the two outer plates 23 and 30, it has been found that it is possible to increase the heat generation over that of a two plate system. However, to maximize the heat distribution one must balance the flow of ignited gas into each of the tailpipes. One can adjust the spacing between the plates so that the gas flow down each tailpipe region is the same. This will result in the tailpipe regions becoming narrower as one approaches the flame spreader.

The ratio of r/R shown in FIG. 1A is critical to proper combustion. If the volume of the combustion chamber 70 is too large, then combustion will become less efficient or may not occur at all. If the gap is too large then the velocity of the gas will slow. The method of adjusting the tailpipes becomes impractical after three intermediate plates are used. One solution is to use a burner that distributes the flame evenly to control the flow of the exhaust gases rather than relying on factors such as plate spacing.

Figure 1B:
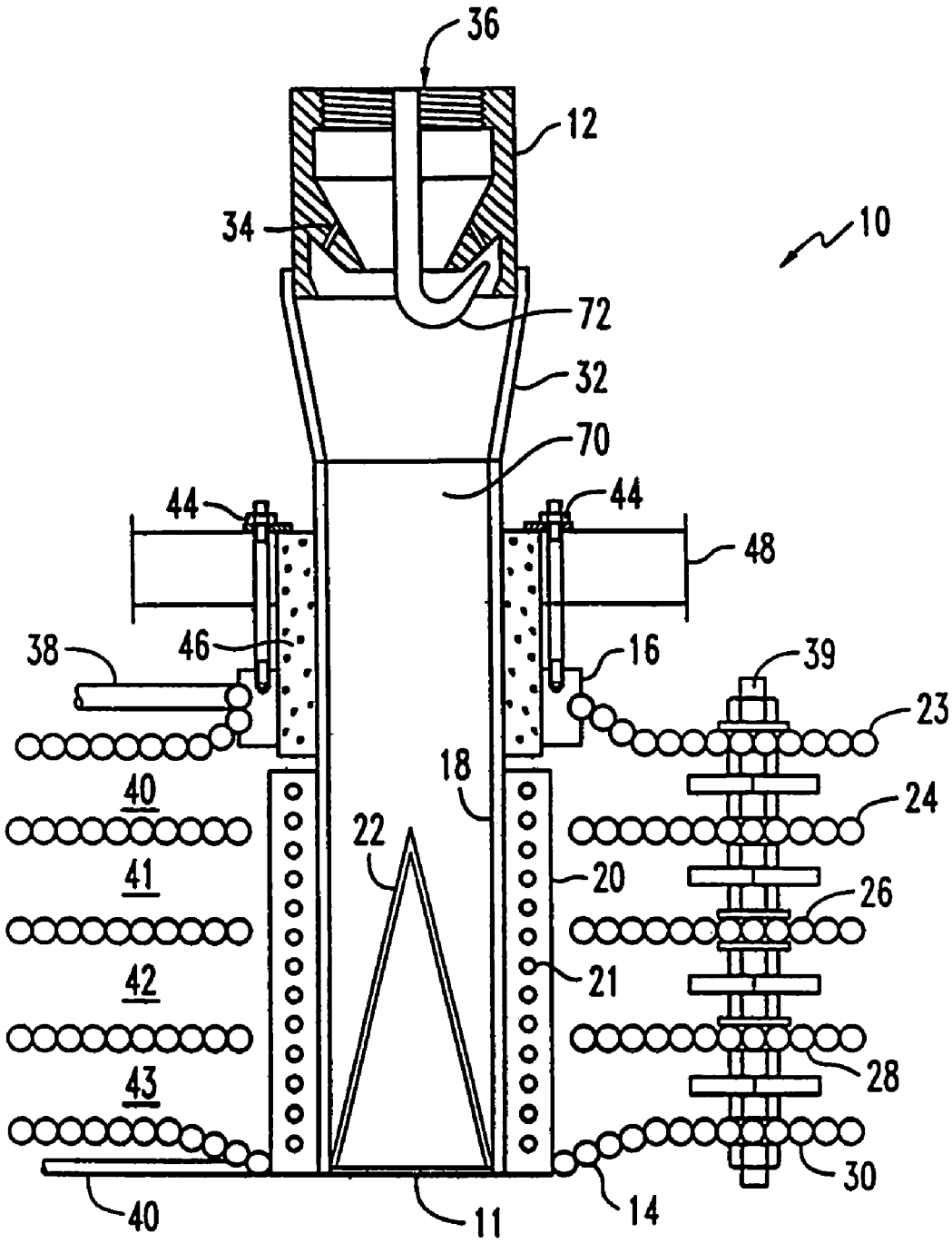
FIG. 1B is a cross-sectional view of a multiple plate combustor assembly with a burner assembly.
Figure 2B:
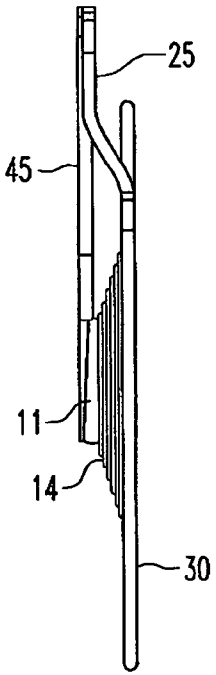
FIG. 2B is a side view of an outer plate with a central hub.
Figure 2A:
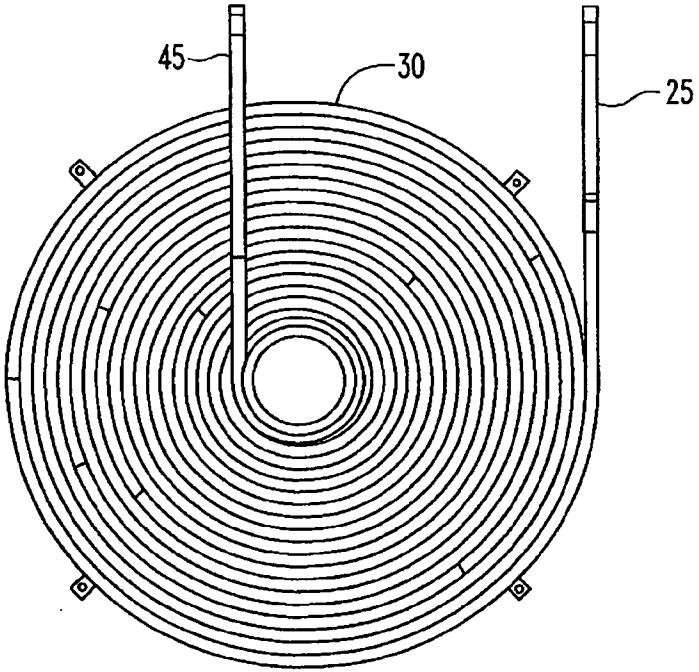
FIG. 2A is a front view of an outer plate with a central hub.

Referring to FIG. 1B, the multiple plate pulse combustor 10 consists of two outer plates or coils 23 and 30 also shown in FIGS. 2A and 2B. A stainless steel cast central hub 11 is mounted in the central opening of plate or coil 30 and an annular hub 16 mounted in the central opening of plate or coil 23. Alternatively, machined (grooved) pipes may be use in place of the cast central hub 11. If pipes are used, a stainless steel plate is welded to one pipe, with the resulting combination referred to herein as a "spreader hub". For the purposes of the description "hub" shall refer to both cast hubs and machined pipes.

Figure 3A:
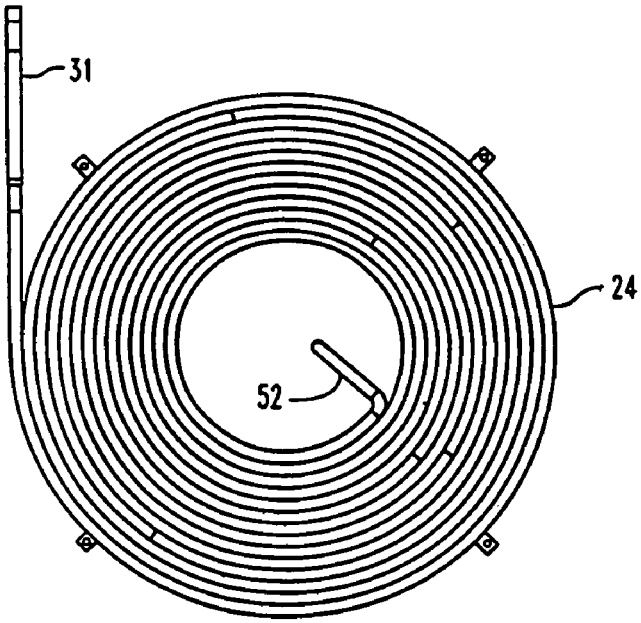
FIG. 3A is a front view of an intermediate plate.
Figure 3B:
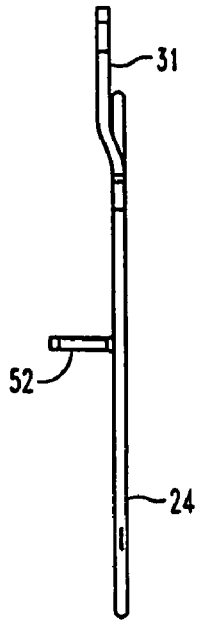
FIG. 3B is a left side view of the intermediate plate of FIG. 3A.

Coiled around each hub 11 and 16 is a stainless steel tube forming plates or coils 30 and 23, respectively. Between these two coils 30 and 23 are located three intermediate coils 24, 26 and 28, made up of stainless steel coils without hubs as shown in FIGS. 3A and 3B. All of the coils 23, 24, 26, 28, and 30 are held in a parallel position, spaced apart a predetermined distance, by means of four stainless steel spacers or rods and adjustment nut assemblies 39 (shown also in FIG. 4B).

The volume contained between the two hubs 11 and 16, together with the volume between conical sections 14 and 74 of the coils 23 and 30, defines the "combustion chamber" of the combustor 10. The volume contained between each set of coils 40, 41, 42, 43 is referred to as the "tailpipe" fox the two coils enclosing that volume. The burner is made up of a central cylindrical stainless steel tube 18 having elongated slots 17 radially spaced around its cylindrical surface (see FIGS. 6A and 6B). Over each slot is affixed a nozzle assembly 20 (see FIGS. 7A, 7B, and 7C), each assembly having a plurality of nozzle openings 21. A cone FIG. 8A 22 is positioned in the tube 18 opposite the nozzle slots 17 with its base closer to the central hub 11 than the annular hub 16. A refractory material 46 surrounds the tube 18 adjacent the elongated slots 17. Hub 16 encloses the refractory material 46 and has a short section of spiral groove around which are formed stainless steel coils of plate or coil 23. Coupled to an open end of tube 18 by means of a frustro-conical section of pipe 32 is a burner nozzle 12. The combustor 10 is mounted to a front panel 48 of a housing (not shown) by means of bolts 44 which are threadedly received by hub 16.

Referring to FIGS. 2A and 2B, outer plate or coil 30 has a central hub 11, a conical region 14, a cooling water inlet 25 at an outer periphery of the coil 30 and a heated water outlet 45.

Referring to FIGS. 3A and 3B, intermediate plates 24, 26, and 28 are formed as flat coils of hollow tubing as represented by coil 24. All are substantially identical and have a wide opening, a cooling water inlet 31 at a periphery and a heated water outlet 52 proximate the center of the coil 24.

Figure 4B:
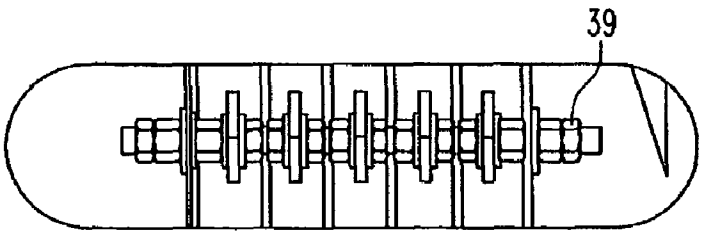
FIG. 4B is a detail view of the plate spacing assembly.
Figure 4A:
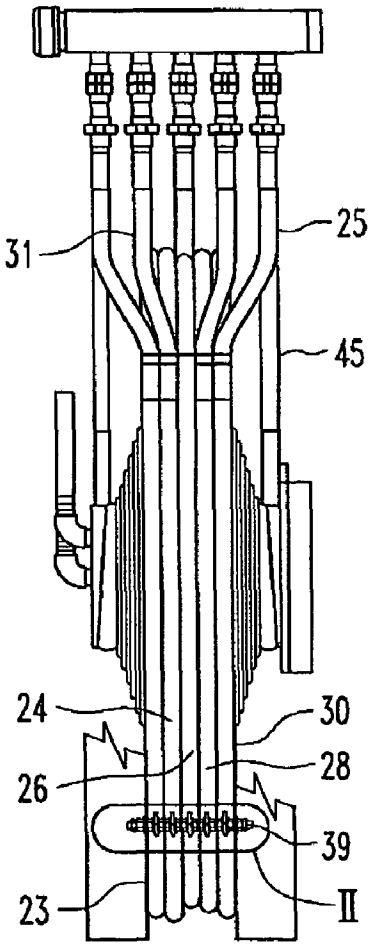
FIG. 4A is a side view of an assembled pulse combustor made up of 5 total plates.

Referring to FIGS. 4A and 4B, an external view of the assembled combustor 10 shows that a bolt with nuts and spacers 39 are used to hold the plates or coils 23, 24, 26, 28 and 30 in position with the plates all parallel to one another.

Figure 5A:
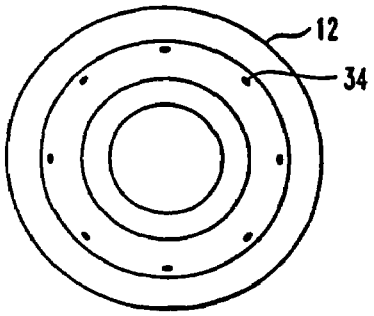
FIG. 5A is a end view of a burner nozzle.
Figure 5B:
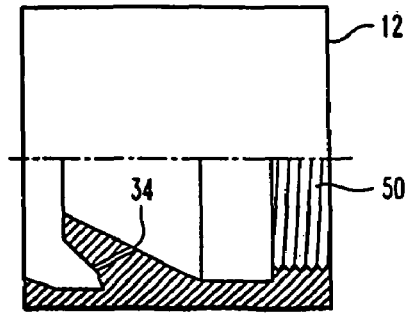
FIG. 5B is a sectional side view of the burner nozzle of FIG. 5A.

Referring to FIGS. 5A and 5B, the burner nozzle 12 has a plurality of radially spaced apart holes 34 which permit the passage of a fuel-air mixture from inlet 50, which mixture is ignited by a sparker (not shown). The majority of the fuel-air mixture passes through the center of the burner assembly 64. FIG. 8A.

Figure 6A:
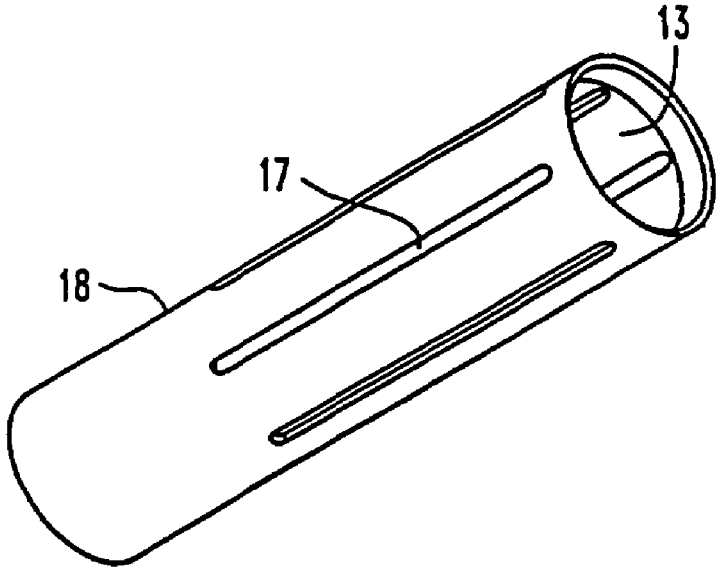
FIG. 6A is a perspective view of a cylinder for making a burner.
Figure 6B:
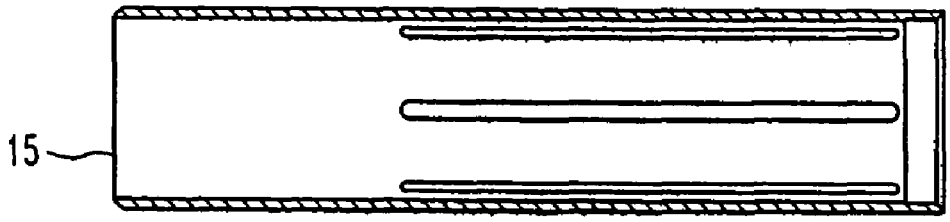
FIG. 6B is side elevation view of the burner of FIG. 6A.

The stainless steel cylinder 18 shown in FIGS. 6A and 6B has a plurality of radially spaced apart, elongated slots 17 through its cylindrical surface, an open end 13 and a closed end 15.

Figure 7A:
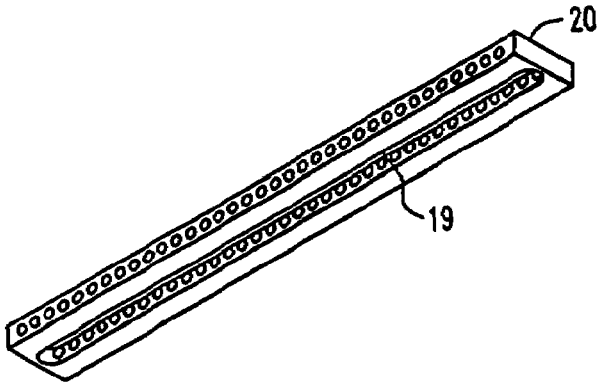
FIG. 7A is a perspective view of a nozzle piece for making a burner.
Figure 7B:
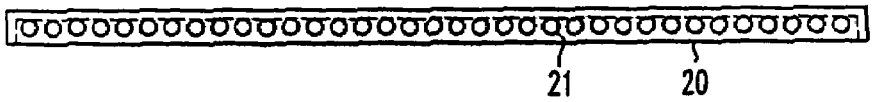
FIG. 7B is a side view of the nozzle piece of FIG. 7A.
Figure 7C:
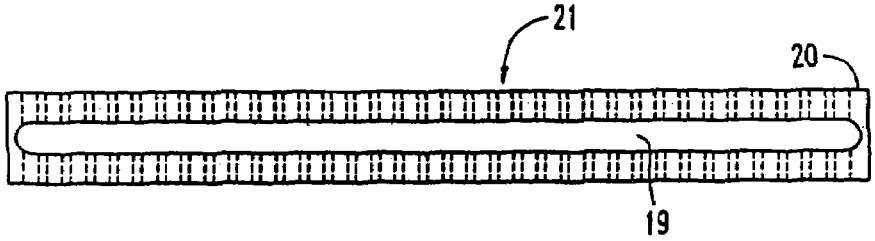
FIG. 7C is a bottom view of the nozzle piece of FIG. 7A.
Figure 8A:
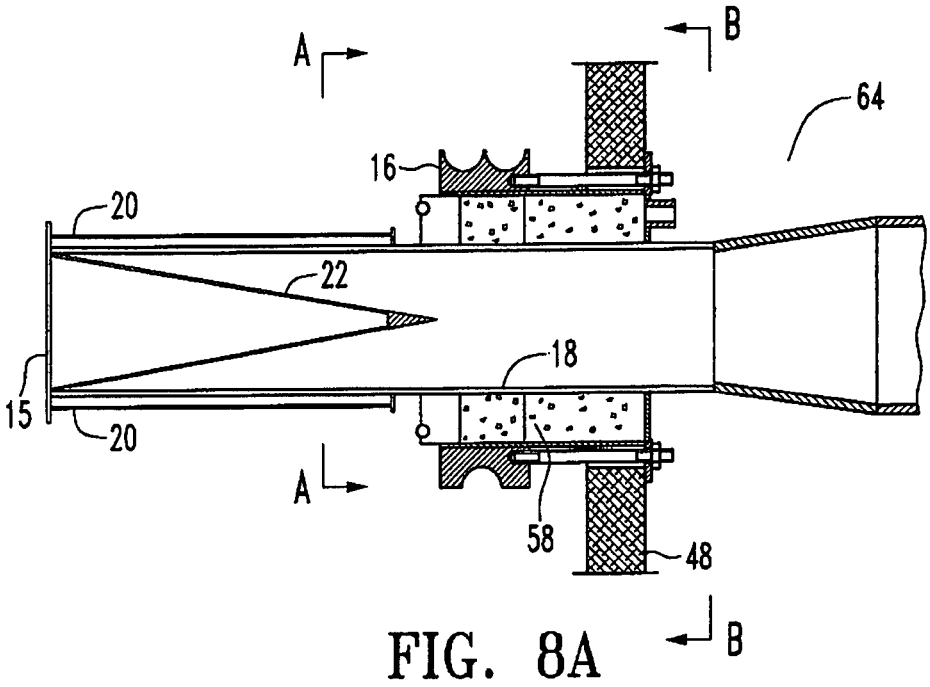
FIG. 8A is a sectional view of a burner assembly.

In FIGS. 7A, 7B, and 7C, the nozzle strip or assembly 20 is an elongated block of metal having a recess 19 that matches the shape of the slots 17 in cylinder 18, and also has a regularly spaced array of transverse, spaced apart bores 21 extending from an interior of the recess 19 to the exterior on either side of the recess 19. The nozzle strip 20 is welded to the cylinder 18 over slots 17

Figure 8B:
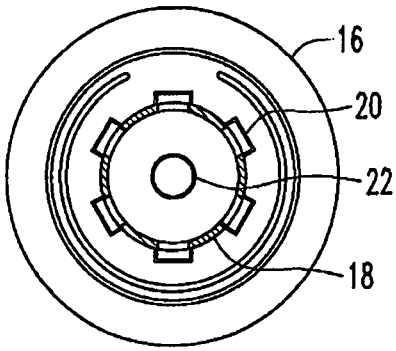
FIG. 8B is view taken along the line AA.
Figure 8C:
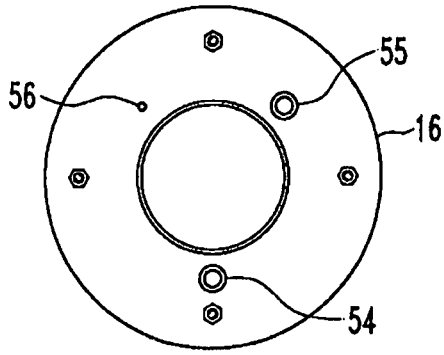
Figure 9:
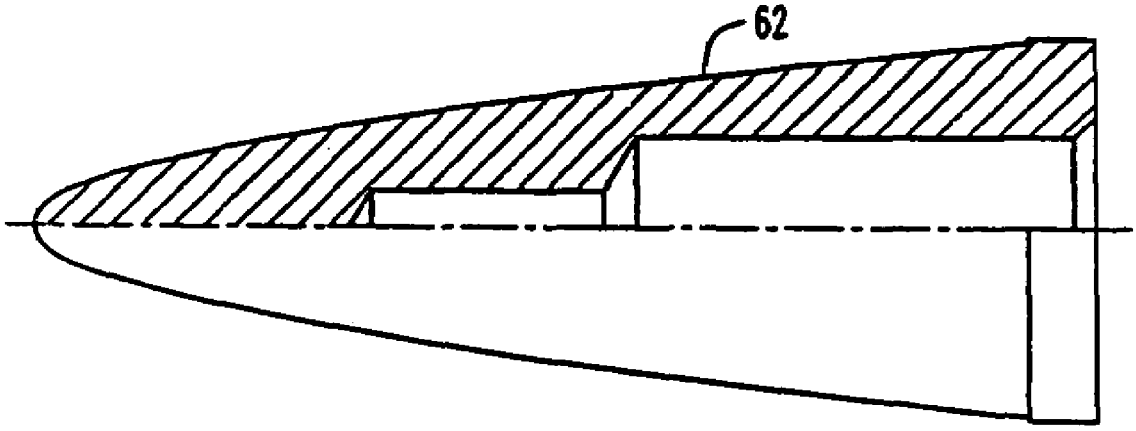
FIG. 9 is a side view partially in section of a cone for use in the burner assembly.

The burner assembly of FIGS. 8A, 8B, and 8C forms the chamber in which combustion takes place and consists of the cylindrical stainless steel chamber 18, the attached nozzle strips 20, and hub 16 which is fitted over a sleeve of refractory material 58. A cone 22 is fitted into cylinder 18 with the base of the cone 22 aligned parallel with the closed end 15 of the cylinder 18. Connections to an igniter 54, a flame sensor 55 and pilot line 56 are made to the refractory material 58. As shown in FIG. 9 the cone structure 62 has a parabolic rather than a conical shape.

In operation, water enters each of coils 23, 24, 26, 28, and 30 at the perimeter and exits at or near the center, thus allowing for counterflow heat exchange.

An air and gas mixture enters the burner assembly through burner nozzle 12, past coupler 32 and into combustion chamber 70 in an interior of cylinder 18. A spark from an ignition rod or spark plug 72, installed in the burner 36 ignites the mixture.

While the combustion cycle is generally reliable, there are a number of design parameters that are significant for proper functioning of the pulse combustor. The first parameter is the velocity of the exhaust gases. The velocity must be controlled such that the low pressure in the combustion chamber is generated at the exact instant when the combustion products reach the perimeter of a given coil. If the velocity of the exhaust gases is too slow, then none of the exhaust gases will exit the combustor 10 to the ambient surroundings. Exhaust gases of a certain mass and volume will remain in the tailpipe and combustion chamber 70. The presence of these exhaust gases will reduce the volume of the new air/gas mixture entering the combustion chamber 70. Therefore, depending on the amount of the exhaust gases remaining from the first cycle, either the second cycle will not take place due to a "choking" effect or unclean or incomplete combustion will occur. As unclean combustion increases the amount of exhaust gases that remain in the tailpipe and combustion chamber, the choking effect will take place eventually.

If the velocity of the exhaust gases is too fast, then a large percentage or all of them will exit into the ambient surroundings. In this case, there will not be a sufficient amount of exhaust gases returning with the rarefaction waves to allow for pre-compression of the air/gas mixture. Without the pre-compression, ignition of the new air/gas mixture does not occur and combustion does not take place.

The next two parameters are the respective volumes of the combustion chamber and tailpipe (the mass of gas to be combusted), which will reflect the desired capacity of the boiler/water heater. The depth and radius of the combustion chamber 70 define its volume. Similarly, the gaps between the flat sections of all the plates 23, 24, 26, 28, and 30 and their radii define the volume of the tailpipe. Therefore, the radius and depth or gap dimensions control the volume of the combustion chamber 70 and tailpipe.

There are operational restrictions on the dimensions of the combustion chamber 70 that prevent arbitrary changes in the radius and depth to obtain a required volume. For example, if depth is increased in order to minimize the radius, beyond a certain optimum value the spreader hub will act as a "heat sink". The flame from the burner will not spread sufficiently over the adjacent coils (the conical section of the heat exchanger), reducing the heat transfer from the flame to the water. Furthermore, the high temperature of the spreader hub will result in high NOx values, which makes the device impractical for many uses.

Conversely, if the depth is reduced below a certain optimum value the required expansion of exhaust gases will not take place, resulting in the choking effect. Also, flame impingement (contacting the spreader hub) will occur, causing unclean combustion and a high CO content in the exhaust gases, which is not allowed under the guidelines of most regulatory and authorizing/certifying agencies. The two effects combine to make the combustor un-usable.

With respect to the plates 23, 24, 26, 28, and 30, the radius R will have a minimum value below which there will be an insufficient amount of available surface for heat transfer. As a result, the gap between two adjacent coils cannot be increased at the expense of smaller radii (to maintain a constant volume). Similarly, the spacing of the gap has its own upper limit, beyond which there will be insufficient contact between the exhaust gases and the plate surface, and the heat of the combustion will not be transferred to the water in the coils 23, 24, 26, 28, and 30. Conversely, if the gap distance is too small, the velocity of the exhaust gases results in a vibration effect on the plates, creating an undesirable loud humming noise and potentially damaging the components of the combustor. Also, more of the exhaust gases will escape into the ambient surroundings, resulting in a less than sufficient amount returning in the form of rarefaction waves to continue combustion.

As a result of the above effects, the radius and depth of the combustion chamber 70, as well as the radius and gap spacing of the plates 23, 24, 26, 28, and 30, must be carefully controlled to ensure that complete pulse combustion is possible.

When the total number of plates is increased beyond two, in addition to the above noted design parameters, a third major feature will play a significant role in the overall operation of the combustor 70. This feature is the optimum and uniform distribution of the exhaust gases in between consecutive coils 23, 24, 26, 28, and 30. With respect to the uniform distribution of gases, there are three major parameters that affect the performance of the combustor.

First, similar to electric current or any fluid, exhaust gases tend to travel the path of least resistance. Second, the flame temperature varies along the flame length (parallel to the axis of the combustion chamber). That is, the tip of the flame has a higher temperature than its origin. Consequently, the exhaust gases and the air surrounding the flame will have different temperatures along the length of the flame and, thus, along the depth of the combustion chamber 70. Finally, due to the direction of the flame, the natural tendency of flame movement (direction of the flame) is towards its tip, therefore towards the last gap between the coils 23, 24, 26, 28, and 30.

As a result, the highest velocity of exhaust gases would be through the last gap adjacent tailpipe region 43. Thus the highest pressure drop occurs through that gap. This pressure drop decreases along the length of flame, from the tip to the source. Therefore, the exhaust gas velocity will be different along the length of the flame and thus along the depth of the combustion chamber 70.

Therefore, the intermediate plates 24, 26, and 28 must be placed parallel transverse to an axis of the combustion chamber 70, such that uniform and equal amount of heat is transported through each gap 40, 41, 42, and 43 by the exhaust gases. As well, the exhaust gases must have the desired velocity to allow optimum heat transfer, pulsation, and low noise operation as described above.

Referring to FIGS. 5A and 5B, which show a series of circular nozzles 34 drilled around the inner periphery of a short cylinder, a mixture of air and gas enters the burner through these nozzles and is combusted by a flame rod (not shown). Flame from these burners follows a straight path with in an elliptical configuration with its longer axis parallel to the axis of the cylinder 18.

In order to be able to obtain maximum heat transfer between the combustion products (exhaust gases) and the water flowing through the coils 23, 24, 26, 28, and 30, allowance has to be made for the loss of flame temperature along the flame's length, and a varying pressure drop through consecutive gaps. In a multiple coil configuration, the natural tendency for heat distribution would be towards the last coil 30 and through the gap between the last two coils 28 and 30. To be able to achieve maximum heat transfer, and the corresponding high efficiency and condensing effect, the exhaust gases have to be distributed uniformly among the gaps or in the tailpipe regions 40, 41, 42, and 43 between consecutive coils. To achieve this objective, without adding any external components to the heat exchanger, the flow of gases must be controlled by creating the appropriate resistance to flow in each gap or tailpipe region. In its simplest terms, resistance to the flow is increased along the length of the flame, from the tip towards the source. Without using a burner this is achieved by adjusting the design of the slope of the conical section of the last coil (which holds the spreader hub), and determining the optimum values for the gaps between consecutive coils. Values of these gaps are determined by using a series of fluid dynamic criteria and equations that involve the flame velocity of propagation, the temperature gradient along the length of the flame, and the velocity of exhaust gases.

II: Use of Specifically Designed Cylindrical Burner

To minimize the effect of the gaps between coils, and the slope of the conical section of the last coil on the heat distribution, an alternative burner can be used. The burner comprises three major components: one stainless steel cylinder (FIG. 6), one stainless steel cone (FIG. 9), and six stainless steel nozzle strips (FIG. 7). Six cuts are made along the transverse axis of the cylinder, equal in length to that of the strips. Each strip is welded on top of each cut. The cone is installed inside the cylinder such that its circular end is on the same plane as one end of the cylinder with its conical end near the other end of the cylinder, where mixture of air and gas enter the cylinder (FIG. 8). The number of slots and nozzle strips may be adjusted, but is always equal.

Each nozzle strip has a number of pre-determined holes patterned in a pre-determined profile, with the most basic profile being a series of equally-spaced apart, identically dimensioned holes. Arrangement of the holes on each strip, length of each strip, nozzle profile, and shape of the cone govern the velocity and distribution of the flame through the cylinder. The result is that the flame is uniformly ejected or distributed from the surface of the cylinder, through the nozzles, into consecutive gaps of the heat exchanger.

The burner is installed on the burner hub by means of a flange (FIG. 8), and is connected to a blower through which the mixture of air and gas flows through the burner. The air/gas mixture is combusted by a spark from the flame rod or igniter. Flames through the nozzle strips are ejected radially outward through consecutive gaps of the combustor. The length of the cylinder is governed by, and proportionate to, the depth of the combustion chamber.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the scope of the invention.

I claim:

1. A pulse combustor, comprising:

a) a first outer plate or coil;

b) a second outer plate or coil spaced apart from and substantially parallel to said first outer plate or coil, wherein said second outer plate or coil comprises a hub;

c) at least one intermediate coil located between and substantially parallel to said first and said second outer plates or coils, wherein said intermediate coil is spaced apart from any adjacent of said intermediate coils and from any adjacent of said first and said second outer plates or coils, whereby tailpipe regions are formed on both sides of said intermediate coil, and wherein said intermediate coil comprises:

i a coolant passageway for conducting coolant through the intermediate coil;

ii an inlet to said coolant passageway; and, iii an outlet from said coolant passageway;

d) a combustion chamber between said first and said second outer plates or coils; and, e) a burner coupled to said hub, said burner operative to ignite a fuel/air mixture in said combustion chamber.

2. A pulse combustor according to claim 1, wherein said intermediate coil is flat.

3. A pulse combustor according to claim 1, wherein at least one of said first outer plate or coil and said second outer plate or coil comprises a central conical region.

4. A pulse combustor according to claim 1 wherein said inlet of said intermediate coil is at the periphery of said intermediate coil.

5. A pulse combustor according to claim 1 wherein said outlet of said intermediate coil is adjacent the center of said intermediate coil.

6. A pulse combustor according to claim 1, further comprising spacing means for holding each intermediate coil a fixed distance from each adjacent intermediate coil or from each adjacent outer coil or plate.

7. A pulse combustor according to claim 6 wherein the fixed distance is predetermined to equalize gas flow through the tailpipe regions.

8. A pulse combustor according to claim 1 wherein said burner further comprises a cylinder having a surface, an open end, and a closed end, and wherein said burner is coupled to said hub at said open end, and wherein said closed end is proximate said second outer plate or coil.

9. A pulse combustor according to claim 8 wherein said burner further comprises a cone mounted in said cylinder, wherein the base of said cone is proximate said closed end of said cylinder.

10. A pulse combustor according to claim 8, wherein said burner further comprises:

a) a plurality of radially spaced apart elongated slots extending along a length of said surface of said cylinder; and, b) a plurality of elongated nozzle assemblies with each of said nozzle assemblies affixed to said surface and over one of said slots, wherein each of said nozzle assemblies comprises:

i) nozzle openings spaced along its length; and, ii) a plenum accessing said nozzle openings.

11. A pulse combustor according to claim 1 wherein said intermediate coil is circular.

* * * * *